US010914135B2

(12) United States Patent
Helms et al.

(10) Patent No.: US 10,914,135 B2
(45) Date of Patent: Feb. 9, 2021

(54) ATTACHMENTS FOR MITIGATING SET CEMENT DOWNHOLE

(71) Applicant: Halliburton Energy Services, Inc., Houston, TX (US)

(72) Inventors: Lonnie Helms, Houston, TX (US); Venkata Gopala Rao Palla, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/495,274

(22) PCT Filed: Sep. 27, 2018

(86) PCT No.: PCT/US2018/053074
§ 371 (c)(1),
(2) Date: Sep. 18, 2019

(87) PCT Pub. No.: WO2020/068083
PCT Pub. Date: Apr. 2, 2020

(65) Prior Publication Data

US 2020/0399978 A1 Dec. 24, 2020

(51) Int. Cl.
*E21B 33/14* (2006.01)
*E21B 33/16* (2006.01)

(52) U.S. Cl.
CPC ..... *E21B 33/167* (2020.05)

(58) Field of Classification Search
CPC ..... E21B 33/14; E21B 33/16; E21B 17/14; E21B 33/13
See application file for complete search history.

(56) References Cited

U.S. PATENT DOCUMENTS 5,494,107 A * 2/1996 Bode ..... E21B 21/10 166/242.8
5,566,772 A * 10/1996 Coone ..... E21B 17/07 166/242.7
6,244,342 B1 6/2001 Sullaway et al.
2004/0177962 A1 9/2004 Bour
2005/0034863 A1 2/2005 Dillenbeck et al.
2007/0062700 A1* 3/2007 Webb ..... E21B 21/10 166/285
2008/0060814 A1 3/2008 Badalamenti et al.
2008/0196889 A1 8/2008 Bour et al.
(Continued)

FOREIGN PATENT DOCUMENTS

WO 2017/111777 A1 6/2017

OTHER PUBLICATIONS

PCT International Search Report and Written Opinion dated Jun. 20, 2019, issued during the prosecution of PCT International Patent Application No. PCT/US2018/053074.

*Primary Examiner* — Kipp C Wallace
(74) *Attorney, Agent, or Firm* — Locke Lord LLP

(57) ABSTRACT

A well tool attachment includes a tubular body with a bore therethrough extending along a longitudinal axis, wherein the tubular body is configured to seat in a shoe track of a well casing. A plurality of partitions are suspended from the tubular body, dividing the bore of the tubular body into a plurality of segments extending axially through the tubular body. The partitions are configured to break up cement slurry entering the bore of the tubular body into a plurality of cement segments to facilitate drilling after downhole cement sets.

15 Claims, 3 Drawing Sheets

(56) References Cited

U.S. PATENT DOCUMENTS

| | | | | |
|---|---|---|---|---|
| 2013/0233549 | A1* | 9/2013 | Boswell | E21B 34/10 166/285 |
| 2016/0010400 | A1* | 1/2016 | Goebel | E21B 23/04 166/285 |
| 2018/0179864 | A1* | 6/2018 | Mitchell | E21B 41/0078 |
| 2018/0274327 | A1* | 9/2018 | Patil | E21B 33/13 |

* cited by examiner

ATTACHMENTS FOR MITIGATING SET CEMENT DOWNHOLE

CROSS REFERENCE TO RELATED APPLICATIONS

This application is the U.S. National Stage of PCT International Application No, PCT/US2018/053074, filed Sep. 27, 2018, the entire disclosure of which is hereby incorporated herein by reference in its entirety.

BACKGROUND OF THE INVENTION

1. Field of the Invention

The present disclosure relates to downhole operations, and more particularly to mitigating cement setting in downhole pipes such as during reverse cementing.

2. Description of Related Art

In conventional cementing for downhole structures, bottom and top plugs are used to keep the sequential fluids separate. These plugs also serve the purpose of indicating to the pump operator, through a pressure spike, that the entire cement slurry is displaced from the pipe to the annulus. During reverse cementing, since the flow happens from the annulus to the pipe, it is not possible to place any plugs in the annulus due to the irregular geometry of the annulus. This makes it difficult for the operator to know when exactly the annulus is fully covered with cement and cement is entering the pipe. Additionally, if the pumping flow is not stopped in time, excessive cement can enter the pipe and can potentially increase the difficulty for subsequent drilling deeper into the formation.

The conventional techniques have been considered satisfactory for their intended purpose. However, there is an ever present need for improved downhole cementing methods and apparatus. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
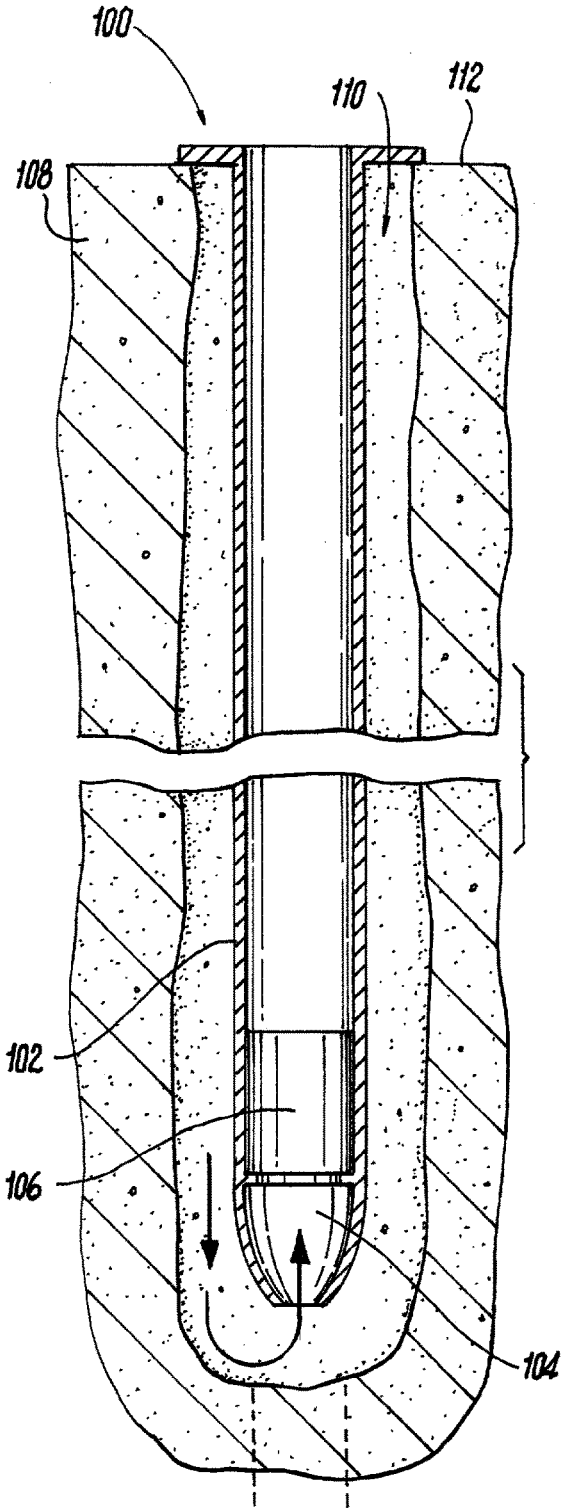
FIG. 1 is a schematic cross-sectional elevation view of an exemplary embodiment of a well tool constructed in accordance with the present disclosure, showing an annulus between a well casing and a formation, with an attachment seated in the shoe track of the well casing, with flow arrows indicating reverse flow cementing.

Reference will now be made to the drawings wherein like reference numerals identify similar structural features or aspects of the subject disclosure. For purposes of explanation and illustration, and not limitation, a partial view of an exemplary embodiment of a well tool in accordance with the disclosure is shown in FIG. 1 and is designated generally by reference character 100. Other embodiments of well tools in accordance with the disclosure, or aspects thereof, are provided in FIGS. 2-7, as will be described. The systems and methods described herein can be used to facilitate downhole operations, such as drilling past a casing that has set cement inside.

Figure 2:
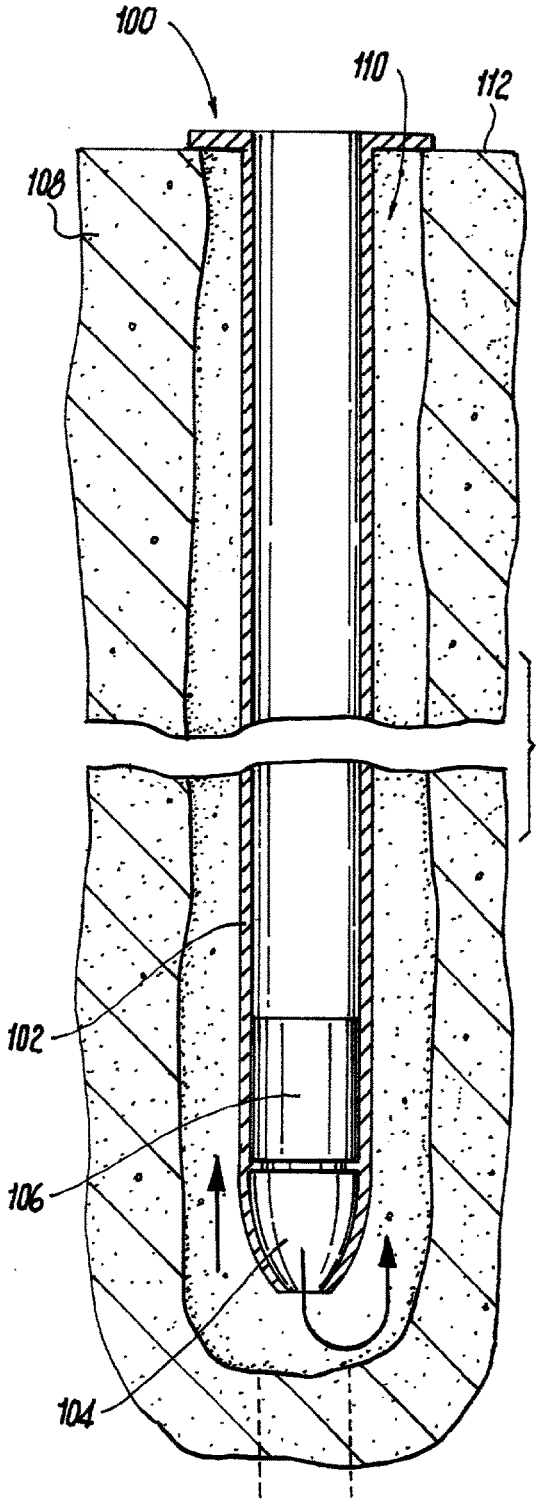
FIG. 2 is a schematic cross-sectional elevation view of the well tool of FIG. 1, showing flow arrows for conventional cement flow.
Figure 4:
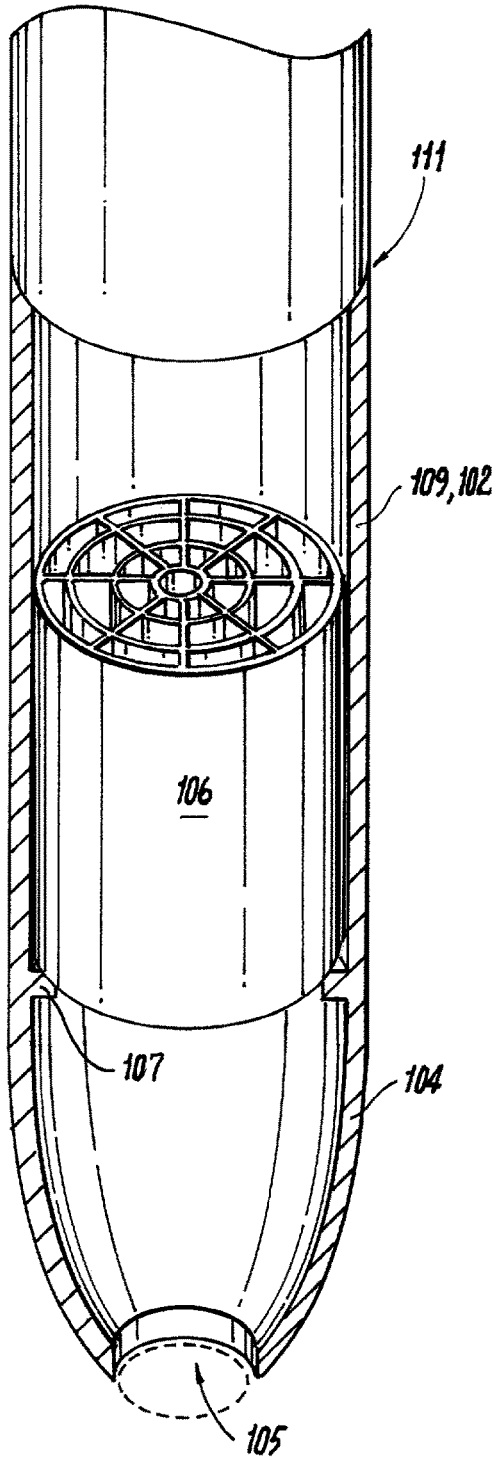
FIG. 4 is a schematic perspective view of the attachment of FIG. 3, showing the attachment seated on a float shoe.

The well tool 100 includes a well casing 102, e.g., a string of individual well casing members, with a float shoe 104. As shown in FIG. 4, an attachment 106 is seated in the shoe track 109, which is the casing 102 between the float collar 111 and the float shoe 104 or guide shoe. The attachment 106 is seated on a seat 107 of the float shoe 104 within the casing 102. Referring again to FIG. 1, the well casing 102 extends downhole in an earth formation 108, with an annulus 110 defined between the well casing 102 and the earth formation 108. Cement slurry can be pumped down into the annulus 110 from the surface 112 to secure the well casing 102 to the earth formation 108, e.g. to enable deeper drilling into the earth formation 108 through the well casing 102. The large arrows in FIG. 1 indicate the flow of cement slurry in reverse cementing, where cement slurry from the surface is pumped downward through the annulus until it begins to enter the well casing 102. FIG. 2 indicates the flow of cement slurry in conventional cementing, where cement slurry from the surface 112 is pumped downward through the inside of well casing 102, out the bottom end of the well casing 102, and upward into the annulus 110. In order to avoid filling the entire well casing 102 with cement slurry during conventional cementing, after a sufficient amount of cement slurry to fill the annulus 110 has been pumped down into the well casing 102, the cement slurry is followed by a pumping fluid downward on the cement slurry in the well casing 102 to continue forcing the cement slurry down out of the well casing 102 and upward into the annulus 110. With either conventional or reverse cementing, the annulus 110 is filled with cement slurry, which is allowed to set, securing the well casing 102 in the earth formation 108. As indicated in FIG. 4, the bottom end 105 of the float shoe 104 can be closed, as indicated by the broken lines in FIG. 4, during some downhole operations to float the well casing 102 with buoyancy forces to reduce the load on surface equipment suspending the well casing 102.

Figure 3:
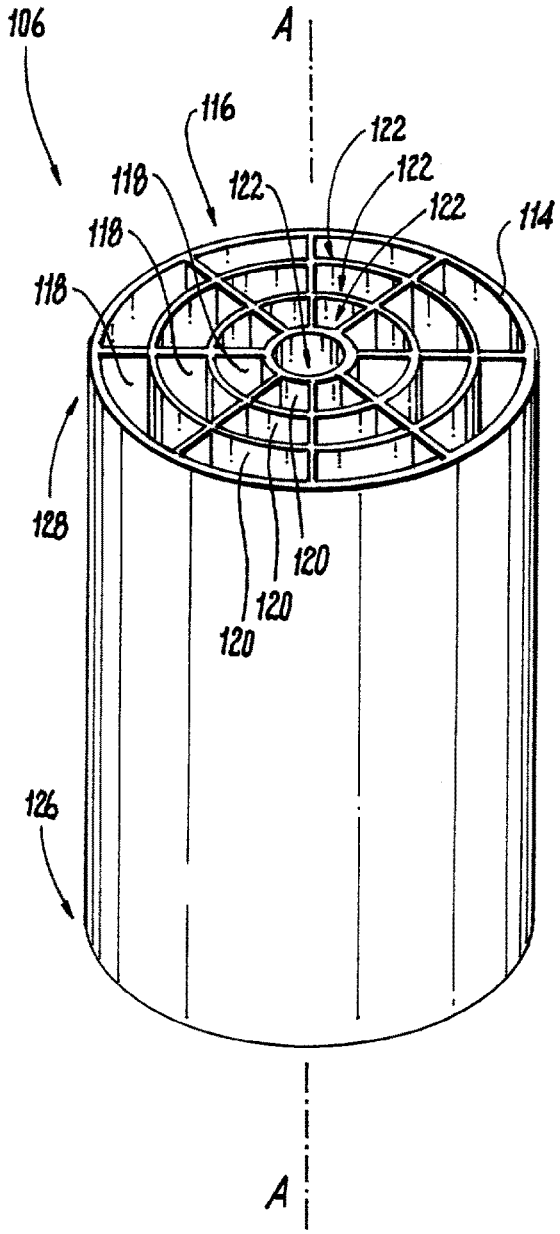
FIG. 3 is a schematic perspective view of the attachment of FIG. 1, showing the tubular body and partitions.
Figure 6:
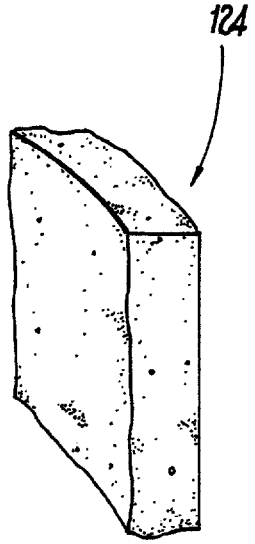
FIG. 6 is a schematic perspective view of a segment of set cement from one of the segments of FIG. 5.
Figure 7:
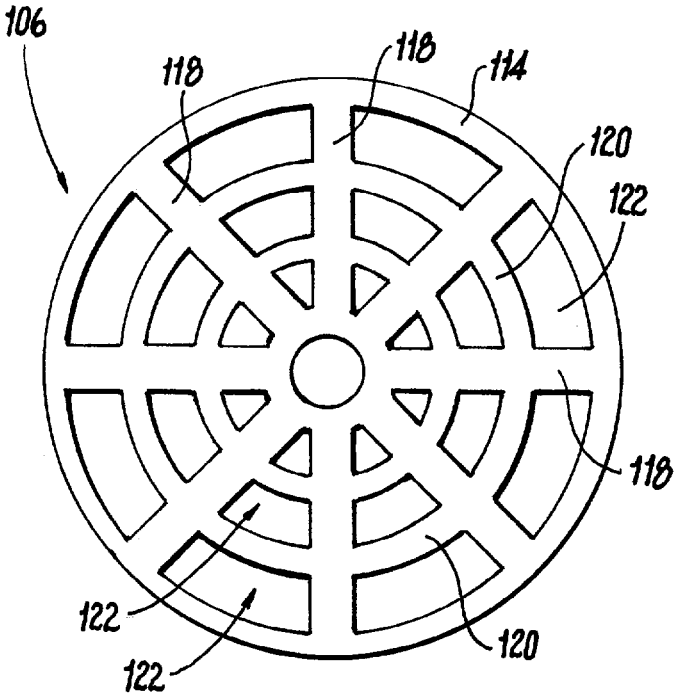
FIG. 7 is a schematic plan view of another exemplary embodiment of an attachment constructed in accordance with the present disclosure, showing constricted segments at one end of the attachment.

With reference now to FIG. 3, the well tool attachment 106 includes a tubular body 114 with a bore 116 therethrough extending along a longitudinal axis A. The tubular body 114 is configured to seat on the seat 107 of the float shoe 104 within the well casing 102 as shown in FIGS. 1-2. A plurality of partitions 118, 120 are suspended from the tubular body 114. The partitions 118, 120 divide the bore 116 of the tubular body 114 into a plurality of segments 122 (e.g. bore segments, not all of which are labeled in FIG. 3 forsake of clarity) extending axially in the direction of the longitudinal axis A through the tubular body 114. The partitions 118, 120 are configured to break up cement slurry entering the bore 116 of the tubular body 114 into a plurality of cement segments 124, one of which is shown in FIG. 6, rather than a single full cylindrical slug of cement, to facilitate drilling after the downhole cement sets.

Figure 5:
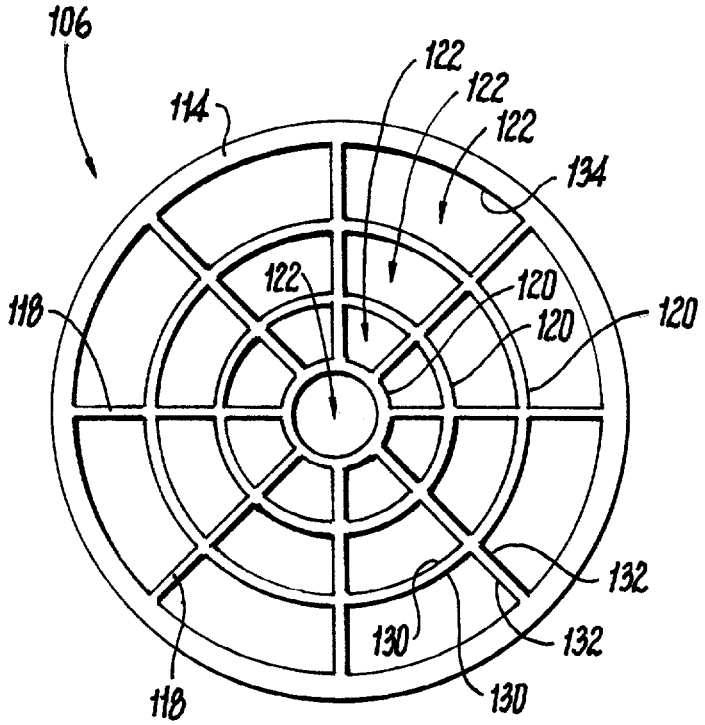
FIG. 5 is a schematic top plan view of the attachment of FIG. 3, showing the constant cross-sectional flow area in the segments.

With continued reference to FIG. 3, the tubular body 116 includes a first axial end 126 and a second axial end 128 axially opposite the first axial end 126 along the longitudinal axis A. The partitions 118, 120 extend fully from the first axial end 126 of the tubular body 106 to the second axial end 128. The partitions 118, 120 can all be parallel to the longitudinal axis A for constant flow area through the tubular body in a direction along the longitudinal axis A. FIG. 5 shows the constant cross-section of the segments 122, not all of which are labeled in FIG. 5 for sake of clarity. It is thus contemplated that the partitions 118, 120 each have a constant cross-sectional thickness that does not change with position along the longitudinal axis A.

It is also contemplated that optionally the partitions 118, 120 can have surfaces that are angled relative to the longitudinal axis A, forming converging flow area for each segment 122 in a direction along the longitudinal axis A from the first axial 126 end of the tubular body to the second axial end 128. In other words, the wall thickness can change from the first end 126 of the attachment 106, which has the cross-section shown in FIG. 5, to a thicker wall thickness at the second end 128 of the attachment 106, which can have a cross-section like that shown in FIG. 7. In this converging variant, the cross-sectional area of each segment 122 of the bore 116 converges along the length of the attachment 106, e.g., as can be seen by comparing the cross-sections shown in FIGS. 5 and 7.

With reference to FIG. 5, at least one of the partitions 118, 120 can include a hydrophobic surface 130, 132 (not all of which are labeled in FIG. 5 for sake of clarity) configured to prevent setting cement bonding to the hydrophobic surface 130, 132. The hydrophobic surfaces 130, 132 can include plastic, or any other suitable material that does not bond to setting cement. There are three circumferential partitions 120 extending circumferentially about the longitudinal axis A (labeled in FIG. 3), with a central, circular segment 122 of the bore 116 inside the inner most of the circumferential partitions 120. There are also six radial partitions 118 extending radially relative to the longitudinal axis A. The radial partitions 118 can each include a hydrophobic surface 132 to prevent setting cement bonding to the radial partitions 118. The tubular body 114 includes an inner surface 134. The inner surface 134 of the tubular body 114 and surfaces 130 of the circumferential partitions 120 can each include a bonding surface, e.g. non-hydrophobic, configured to bond with setting cement to prevent set cement segments 124 (see FIG. 6) moving circumferentially in bearing motion during drilling to break up the cement segments 124. Optionally, the tubular body 114 can be omitted and the radial partitions 118 can sit on the seat 107 of the float shoe 104, for example, or said in other words, the radial partitions 118 can extend beyond the tubular body 114.

The method includes pumping cement downhole on a first side of a well casing, e.g., well casing 102, until cement reaches a bottom end of the well casing and begins to return back uphole on a second side of the well casing as shown in either FIG. 1 or FIG. 2. The method includes ceasing pumping cement downhole when an end of the cement flow enters an attachment, e.g. attachment 106, seated in a shoe track 109, e.g., on a seat 107 of a float shoe 104, in the well casing. The method includes setting the cement downhole, including setting segmented cement, e.g., in segments 124 as shown in FIG. 6, in the attachment. The method includes breaking up the segmented cement in the attachment to drill further beyond the casing, e.g., as indicated by the broken lines in FIGS. 1 and 2. The segmenting of the set cement in the attachment 106, as opposed to a single block of cement, is easier to dismantle when drilling ahead, since the segments of cement can be fragmented more easily and dismantled from the attachment and can fall off easily, offering little or no resistance to drilling. This reduces the effort and time required to drill ahead after the cement sets, compared to traditional techniques.

Pumping cement downhole on the first side of the well casing can include pumping cement down an annulus, e.g., annulus 110 as shown in FIG. 1, between the well casing and an earth formation, e.g. earth formation 108, wherein ceasing pumping cement includes ceasing pumping cement when cement from the annulus enters the well casing and flows into the attachment.

In reverse cementing, the attachment can optionally form converging flow areas as described above for the segments, e.g. segments 122, of the bore, e.g., bore 116. The flow areas can converge in a direction along the longitudinal axis, e.g., longitudinal axis A, as explained above, wherein the flow area converges from the first axial end, e.g., first axial end 126, of the tubular body to the second axial end, e.g., second axial end 128. In this configuration, the second axial end (with smaller flow area) is above the first axial end, so ceasing pumping cement can include ceasing pumping cement upon a pumping pressure rise from cement slurry entering the converging flow area, e.g., traveling upward into the attachment.

In conventional cementing, it is contemplated that pumping cement downhole on the first side of the well casing can include pumping cement down inside the well casing, as shown in FIG. 2, and flowing the cement up from a bottom end of the well casing into the annulus between the well casing and the earth formation. A plurality of the partitions can optionally form converging flow areas as described above, but in a direction along the longitudinal axis from the first axial end of the tubular body to the second axial end. In other words, in normal cementing, the convergence of the flow areas can be converging from top down, wherein the second axial end with smaller flow area is below the first axial end. Ceasing pumping cement can include ceasing pumping cement upon a pumping pressure drop from a trailing end of the cement slurry exiting the converging flow area of the attachment. Using converging flow areas for conventional cementing may be less advantageous than in reverse cementing, since in conventional cementing, the cement plugs can provide an end-of-job indicator. Benefits of systems and methods as disclosed herein can be gained in in conventional cementing without using converging flow areas.

Those skilled in the art will readily appreciate that the partitions 118, 120 in the radial and circumferential configuration shown in FIG. 5 with a central, cylindrical segment 122 are exemplary only, and that any other partition configuration or number of partitions can be used without departing from the scope of this disclosure.

Systems and methods as disclosed herein provide potential advantages over conventional configurations. Attachments as disclosed herein can be more cost effective that traditional non-return valves or other tools used to prevent cement slurry entering and setting in well casing, and can be more inexpensive and more easy to deploy. Systems and methods disclosed herein can save rig time, making it easier and faster to drill ahead, reducing non-productive time (NPT) relative to traditional techniques. Systems and method disclosed herein can also reduce wear and tear of drill bits and thereby help maximize asset value of drill bits relative to traditional techniques.

Accordingly, as set forth above, the embodiments disclosed herein may be implemented in a number of ways. For example, in general, in one aspect, the disclosed embodiments relate to a well tool attachment for well casings. The well tool attachment includes a tubular body with a bore therethrough extending along a longitudinal axis, wherein the tubular body is configured to seat in a shoe track of a well casing. A plurality of partitions are suspended from the tubular body, dividing the bore of the tubular body into a plurality of segments extending axially through the tubular body. The partitions are configured to break up cement slurry entering the bore of the tubular body into a plurality of cement segments to facilitate drilling after downhole cement sets.

In general, in another aspect, the disclosed embodiments relate to a well tool. The well tool includes a well casing with a shoe track. An attachment, as disclosed herein, is seated in the shoe track of the casing.

In general, in another aspect, the disclosed embodiments relate to a method of downhole cementing. The method includes pumping cement downhole on a first side of a well casing until cement reaches a bottom end of the well casing and begins to return back uphole on a second side of the well casing. The method includes ceasing pumping cement downhole when an end of the cement flow enters an attachment, as disclosed herein, seated in a shoe track of the well casing. The method includes setting the cement downhole, including setting segmented cement in the attachment. The method includes breaking up the segmented cement in the attachment to drill further beyond the casing.

In accordance with any of the foregoing embodiments, the tubular body can include a first axial end and a second axial end axially opposite the first axial end along the longitudinal axis, wherein the partitions extend fully from the first axial end of the tubular body to the second axial end. The partitions can all be parallel to the longitudinal axis for constant flow area through the tubular body in a direction along the longitudinal axis. The partitions can each have a constant cross-sectional thickness that does not change with position along the longitudinal axis. The plurality of the partitions can have surfaces that are angled relative to the longitudinal axis, forming converging flow area in a direction along the longitudinal axis from the first axial end of the tubular body to the second axial end.

In accordance with any of the foregoing embodiments, at least one of the partitions can include a hydrophobic surface configured to prevent setting cement bonding to the hydrophobic surface. The plurality of partitions can include a plurality of circumferential partitions extending circumferentially about the longitudinal axis, wherein the partitions include a plurality of radial partitions extending radially relative to the longitudinal axis. The radial partitions can each include a hydrophobic surface to prevent setting cement bonding to the radial partitions. The tubular body can include an inner surface. The inner surface of the tubular body and the circumferential partitions can each include a bonding surface configured to bond with setting cement to prevent set cement segments moving circumferentially during drilling to break up the cement segments.

In accordance with any of the foregoing embodiments, pumping cement downhole on the first side of the well casing can include pumping cement down an annulus between the well casing and an earth formation, wherein ceasing pumping cement includes ceasing pumping cement when cement from the annulus enters the well casing and flows into the attachment. A plurality of the partitions can have surfaces that are angled relative to the longitudinal axis, forming converging flow area in a direction along the longitudinal axis from the first axial end of the tubular body to the second axial end. The second axial end can be above the first axial end, wherein ceasing pumping cement includes ceasing pumping cement upon a pumping pressure rise from cement slurry entering the converging flow area. It is also contemplated that pumping cement downhole on the first side of the well casing can include pumping cement down inside the well casing and flowing the cement up from a bottom end of the well casing into an annulus between the well casing and an earth formation. A plurality of the partitions can have surfaces that are angled relative to the longitudinal axis, forming converging flow area in a direction along the longitudinal axis from the first axial end of the tubular body to the second axial end, wherein the second axial end is below the first axial end. Ceasing pumping cement can include ceasing pumping cement upon a pumping pressure drop from a trailing end of the cement slurry exiting the converging flow area.

The methods and systems of the present disclosure, as described above and shown in the drawings, provide for downhole with superior properties including reduced cost, easier deployment, reduced rig time, facilitated drilling, and improved drill bit life. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A well tool attachment for well casings comprising:

a tubular body with a bore therethrough extending along a longitudinal axis, wherein the tubular body is configured to seat in a shoe track of a well casing; and a plurality of partitions suspended from the tubular body, dividing the bore of the tubular body into a plurality of segments extending axially through the tubular body, wherein the partitions are configured to break up cement slurry entering the bore of the tubular body into a plurality of cement segments to facilitate drilling after downhole cement sets, wherein the plurality of partitions include a plurality of circumferential partitions extending circumferentially about the longitudinal axis, wherein the partitions include a plurality of radial partitions extending radially relative to the longitudinal axis, wherein the radial partitions each include a hydrophobic surface to prevent setting cement bonding to the radial partitions, wherein the tubular body includes an inner surface, wherein the inner surface of the tibular body and the cirumferential partitions each include a bonding surface configured to bond with setting cement to prevent set cement segments moving circumferentially during drilling to break up the cement segments.

2. The well tool attachment as recited in claim 1, wherein the tubular body includes a first axial end and a second axial end axially opposite the first axial end along the longitudinal axis, wherein the partitions extend fully from the first axial end of the tubular body to the second axial end.

3. The well tool attachment as recited in claim 1, wherein the partitions are all parallel to the longitudinal axis for constant flow area through the tubular body in a direction along the longitudinal axis.

4. The well tool attachment as recited in claim 3, wherein the partitions each have a constant cross-sectional thickness that does not change with position along the longitudinal axis.

5. The well tool attachment as recited in claim 1, wherein a plurality of the partitions have surfaces that are angled relative to the longitudinal axis, forming converging flow area in a direction along the longitudinal axis from the first axial end of the tubular body to the second axial end.

6. The well tool attachment as recited in claim 1, wherein at least one of the partitions includes a hydrophobic surface configured to prevent setting cement bonding to the hydrophobic surface.

7. A method of downhole cementing comprising:

pumping cement downhole on a first side of a well casing until cement reaches a bottom end of the well casing and begins to return back uphole on a second side of the well casing;

ceasing pumping cement downhole when an end of the cement flow enters a n attachment seated in a shoe track of the well casing, wherein the attachment includes:

a tubular body with a bore therethrough extending along a longitudinal axis, wherein the tubular body is configured to seat in the shoe track of the well casing;

a plurality of partitions suspended from the tubular body, dividing the bore of the tubular body into a plurality of segments extending axially through the tubular body, wherein the partitions are configured to breakup cement slurry entering the bore of the tubular body into a plurality of cement segments to facilitate drilling after downhole cement sets;

setting the cement downhole, including setting segmented cement in the attachment; and breaking up the segmented cement in the attachment to drill further beyond the casing;

wherein the plurality of partitions include a plurality of circumferential partitions extending circumferentially about the longitudinal axis, wherein the partitions include a plurality of radial partitions extending radially relative to the longitudinal axis, wherein the radial partitions each include a hydrophobic surface to prevent setting cement bonding to the radial partitions, and wherein the tubular body includes an inner surface, wherein the inner surface of the tubular body and the circumferential partitions each include a bonding surface configured to bond with setting cement to prevent set cement segments moving circumferentially during drilling to break up the cement segments.

8. The method as recited in claim 7, wherein pumping cement downhole on the first side of the well casing includes pumping cement down an annulus between the well casing and an earth formation, wherein ceasing pumping cement includes ceasing pumping cement when cement from the annulus enters the well casing and flows into the attachment.

9. The method as recited in claim 8, wherein a plurality of the partitions have surfaces that are angled relative to the longitudinal axis, forming converging flow area in a direction along the longitudinal axis from the first axial end of the tubular body to the second axial end, wherein the second axial end is above the first axial end, wherein ceasing pumping cement includes ceasing pumping cement upon a pumping pressure rise from cement slurry entering the converging flow area.

10. The method as recited in claim 7, wherein pumping cement downhole on the first side of the well casing includes pumping cement down inside the well casing and flowing the cement up from a bottom end of the well casing into an annulus between the well casing and an earth formation.

11. The method as recited in claim 10, wherein a plurality of the partitions have surfaces that are angled relative to the longitudinal axis, forming converging flow area in a direction along the longitudinal axis from the first axial end of the tubular body to the second axial end, wherein the second axial end is below the first axial end, wherein ceasing pumping cement includes ceasing pumping cement upon a pumping pressure drop from a trailing end of the cement slurry exiting the converging flow area.

12. The method as recited in claim 7, wherein the tubular body includes a first axial end and a second axial end axially opposite the first axial end along the longitudinal axis, wherein the partitions extend fully from the first axial end of the tubular body to the second axial end.

13. The method as recited in claim 7, wherein the partitions are all parallel to the longitudinal axis for constant flow area through the tubular body in a direction along the longitudinal axis.

14. The method as recited in claim 13, wherein the partitions each have a constant cross-sectional thickness that does not change with position along the longitudinal axis.

15. The method as recited in claim 7, wherein at least one of the partitions includes a hydrophobic surface configured to prevent setting cement bonding to the hydrophobic surface.

* * * * *